US006064024A

United States Patent [19]

Moldovan

[11] Patent Number: 6,064,024

[45] Date of Patent: May 16, 2000

[54] MAGNETIC ENHANCED ARC EXTINGUISHER FOR SWITCHING ASSEMBLIES HAVING ROTATABLE PERMANENT MAGNETS IN HOUSINGS MOUNTED TO FIXED CONTACTS

[75] Inventor: Peter K. Moldovan, Cascade, Wis.

[73] Assignee: Eaton Corporation, Cleveland, Ohio

[21] Appl. No.: 09/344,680

[22] Filed: Jun. 25, 1999

[51] Int. Cl.[7] ..... H01H 9/30; H01H 33/04

[52] U.S. Cl. ..... 218/22; 218/26; 218/38; 335/201

[58] Field of Search ..... 218/22, 23, 24, 218/25, 26, 27, 28, 29, 30, 31, 32, 33, 34; 335/153, 177, 183, 201, 209, 210, 302

[56] References Cited

U.S. PATENT DOCUMENTS 3,976,962 8/1976 Seeley ..... 335/153

4,424,428 1/1984 Bernard et al. ..... 218/26

5,763,847 6/1998 Moldovan et al. ..... 218/38

*Primary Examiner*—J. R. Scott

*Attorney, Agent, or Firm*—Quarles & Brady LLP; George E. Haas, Esq.

[57] ABSTRACT

A DC contactor has stationary and movable contacts. A magnet is rotatably mounted adjacent to the stationary contact within a self magnetic field produced by the flow of electric current in the stationary contact. The magnet rotates so that its magnetic field extends around the stationary contact in the same direction as the self magnetic field. When an arc forms between the stationary and movable contacts, interaction with the self magnetic field and the magnetic field drives the arc toward an adjacent extinguishing chamber.

15 Claims, 2 Drawing Sheets

FIG. 2
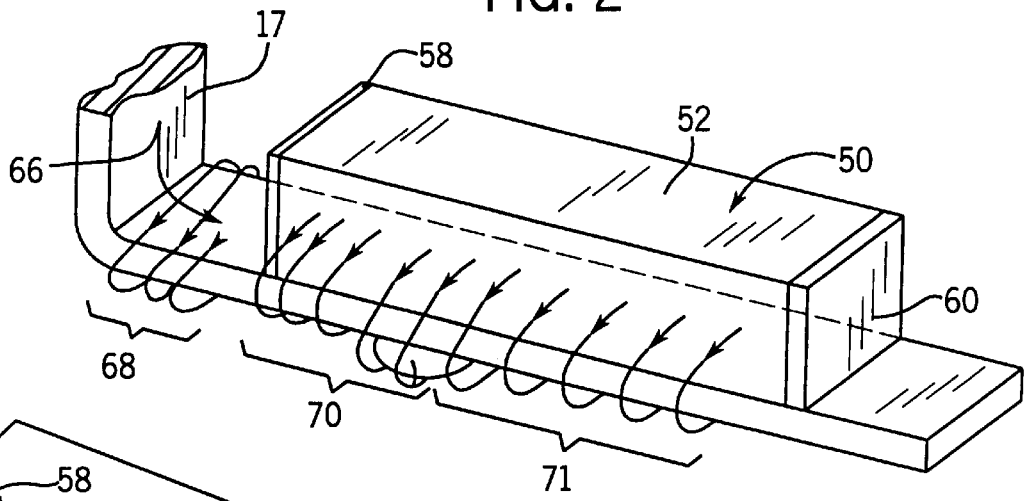
FIG. 3
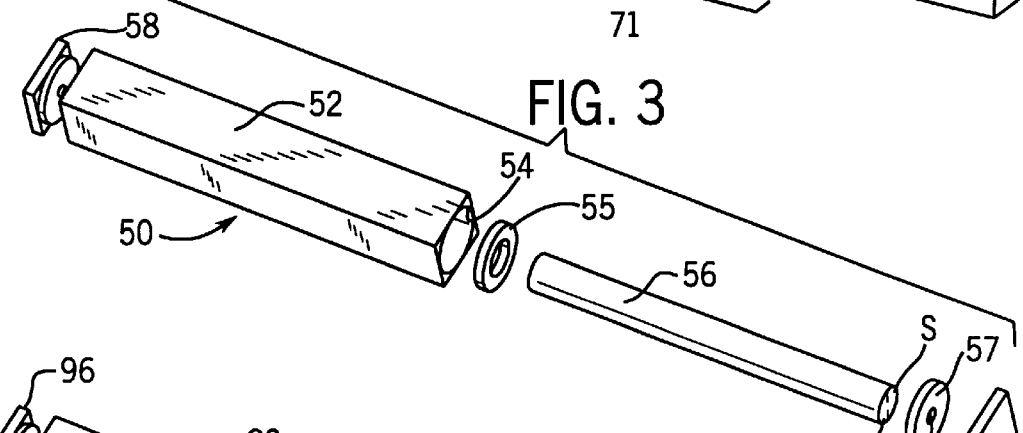
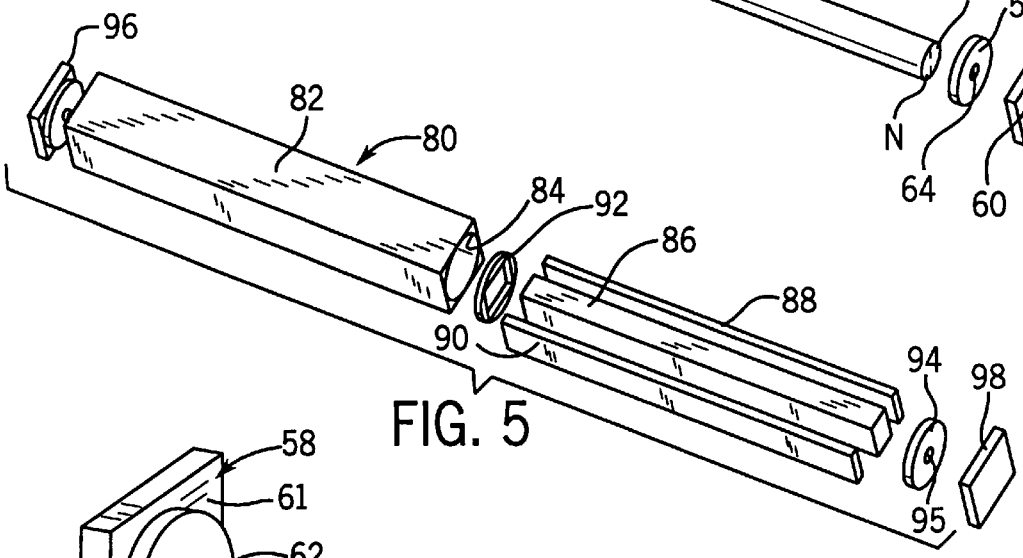
FIG. 5
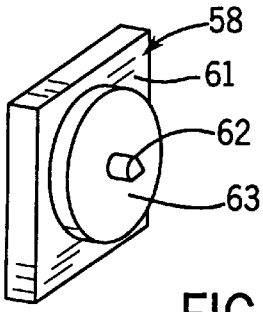
FIG. 4

MAGNETIC ENHANCED ARC EXTINGUISHER FOR SWITCHING ASSEMBLIES HAVING ROTATABLE PERMANENT MAGNETS IN HOUSINGS MOUNTED TO FIXED CONTACTS

BACKGROUND OF THE INVENTION

This invention relates to apparatus for switching electric current, such as direct current (DC) electricity; and more particularly to such apparatus which has a mechanism for extinguishing arcs formed between switch contacts during separation.

DC electricity is used in a variety of applications such as battery powered systems, drives for motors and accessory circuits, in which contactors are used to make and break the flow of current to the load. Weight, reliability and high DC voltage switching and interrupting capability are important considerations in developing the contactor.

In many applications relatively large direct currents must be switched which produce arcs when the contacts of the contactor separate, thereby requiring a mechanism for extinguishing the arcs. Previous DC contactors and switches incorporated one or more arc extinguishing chambers, often referred to as "arc chutes" such as described in U.S. Pat. No. 5,866,864, to extinguish arcs that formed between the switch contacts. Arc extinguishing chambers may comprise a series of spaced apart electrically conductive splitter plates.

The self magnetic field produced by current flowing through conductors in the contactor interacts with the arc creating a Lorentz force that drives the arc towards the extinguishing chamber. In DC switching devices, permanent magnets on the sides of the series of splitter plates establish another magnetic field across the entire arc extinguishing chamber which assists the self-field to drive the arc off the contacts and direct the arc into the splitter plate arrangement. The arc then propagates from one splitter plate to another in the series and eventually spanning a number of gaps between the splitter plates whereby sufficient arc voltage is built up that the arc is extinguished.

The disadvantage of using permanent magnets is that the contactor is polarized in that arc current flowing in only one direction produces a Lorentz force in a direction that drives the arc into the extinguishing chamber. The Lorentz force produced by arc current in the opposite direction inhibits the arc from moving toward and into the second extinguishing chamber. A common contactor has a pair of stationary contacts and a movable bridging contact with separate arc extinguishing chambers for each stationary contact. In this contactor, the direction of the DC current determines which arc chamber is active in a bidirectional contactor with permanent magnets. However, it is desirable to provide arc extinction which is not dependent upon the polarity of a permanent magnet. This allows both arc chambers to be simultaneously active thus allowing the interruption of twice the magnitude of source voltage, in a non-polarized (bidirectional) operating mode, than that achievable in prior permanent magnet based bidirectional contactors.

SUMMARY OF THE INVENTION

The present invention provides a current switching apparatus incorporating a mechanism that extinguishes arcs which form when the switch contacts separate. In particular, a rotating permanent magnet is employed to enhance the forces that drive the arc towards the extinguishing mechanism.

The electric current switching apparatus includes first and second contacts that are movable with respect to each other into an abutting position and an non-abutting position. The first contact has a conductive member through electric current flows when the first and second contacts are in the abutting position. That electric current produces a self magnetic field which extends in a direction around the conductive member.

A magnet is rotatably mounted adjacent the first contact and within the self magnetic field. The magnet produces a magnetic field which extends around the conductive member. The magnet is able to rotate so that its magnetic field extends in the same direction as the self magnetic field, even when the self magnetic field is weak, due to a small electric current, and changes direction due to a change in the direction of the electric current flowing through the first contact.

In the preferred embodiment, the apparatus also includes an arc extinguishing chamber adjacent the first and second contacts. When an arc forms between the first and second contacts, interaction with the self magnetic field and the magnetic field drives the arc toward the extinguishing chamber.

BRIEF DESCRIPTION OF THE DRAWINGS

FIG. 2 is an isometric view of a magnet assembly in the contactor;

FIG. 3 is an exploded view of the magnet assembly;

FIG. 4 illustrates details of an end plate for the magnet assembly; and

FIG. 5 is an exploded view of an alternative magnet assembly for the contactor.

DETAILED DESCRIPTION OF THE INVENTION

Figure 1:
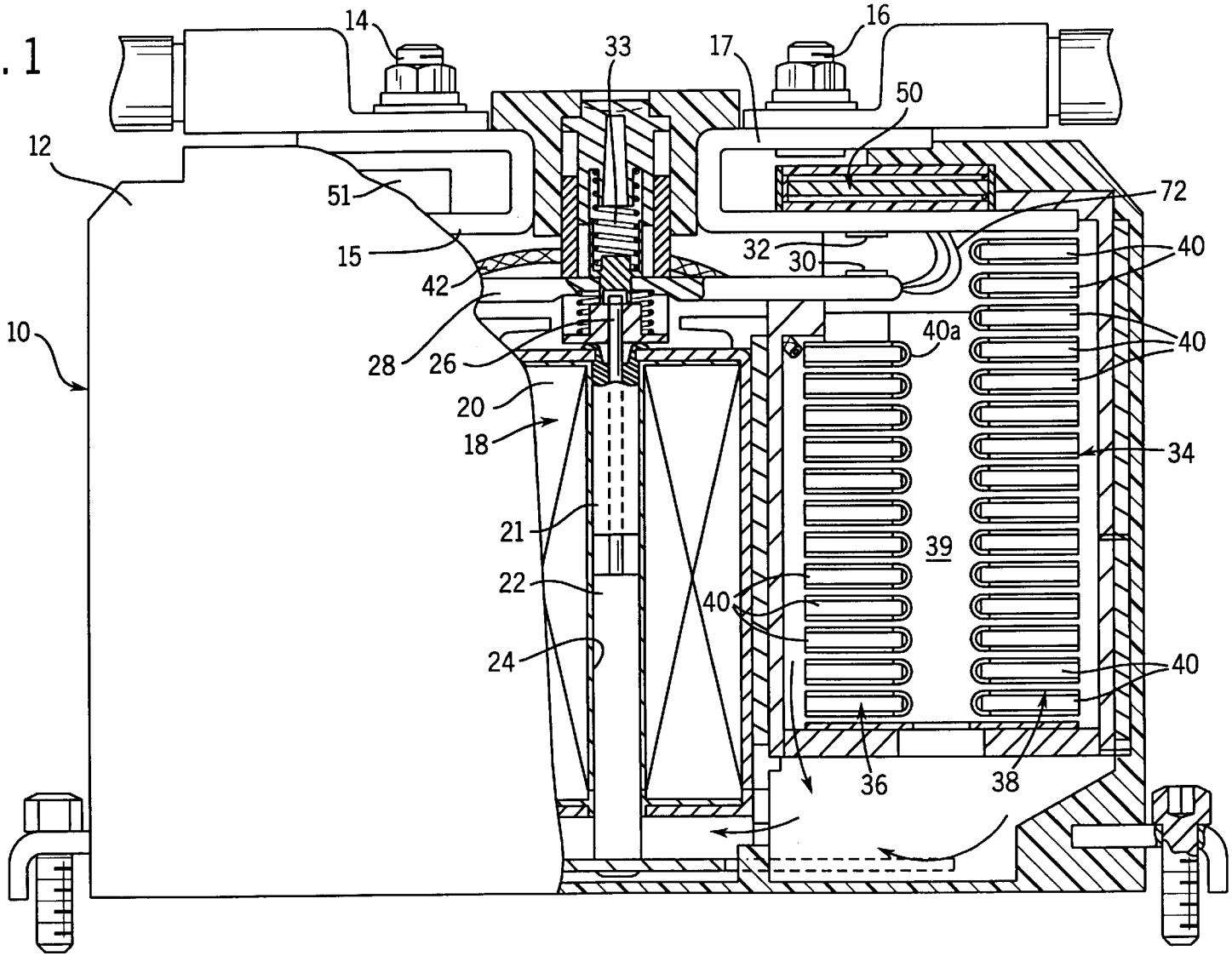
FIG. 1 is a cut away view of a contactor which incorporates an arc extinguishing chamber according to the present invention.

With reference to FIG. 1, a sealed electromagnetic single pole contactor 10 has a plastic housing 12 with first and second power terminals 14 and 16. The first power terminal 14 is connected to a first stationary contact 15 that is attached to the housing, and the second power terminal 16 is connected to a second stationary contact 17.

An electromagnetic solenoid 18 nests in recesses in the interior surfaces of the housing 12. The solenoid 18 has an annular coil 20, a core 21 and an armature 22 located within the central opening 24. The armature 22 includes a shaft 26 that passes through the core 21 and connects to a moveable contact arm 28, which in the closed state of the contactor 10 bridges the stationary contacts 15 and 17 completing an electrical path between the power terminals 14 and 16. Each end of the moveable contact arm 28 has a contact pad 30 which in the closed state abuts a mating contact pad 32 on the stationary contact 15 or 17 associated with that end of the moveable contact arm. A spring assembly 33 biases the moveable contact arm 28 and the armature 22 so that the contactor 10 is in a normally open position when the solenoid coil 20 is de-energized, as illustrated in FIG. 1.

Each end of the moveable contact arm 28 extends into a separate arc extinguishing chamber. The two arc extinguishing chambers are mirror images of each other with one chamber 34 visible in FIG. 1. Arc extinguishing chamber 34 is formed by two stacks 36 and 38 of spaced apart splitter plates 40 with a region 39 between the stacks. The arc extinguishing chamber 34 has a conventional design, such as the one described in U.S. Pat. No. 5,866,864, which description is incorporated herein by reference. Specifically, the top splitter plate 40*a* in the inner stack 36 beneath the second power terminal 16 is connected by a wire braid 42 to the corresponding splitter plate in the inner stack of the arc extinguishing chamber beneath the first power terminal 14.

With reference to FIGS. 1 and 2, the arc extinguishing mechanism further includes magnet assemblies 50 and 51 which respectively abut the first and second stationary contacts 15 and 17 on the opposite side from the contact pad 32. Each magnet assembly 50 and 51 extends from adjacent the bend in the respective stationary contact to slightly beyond the edge of the topmost splitter plate 40 in the outside stack 38. The plastic contactor housing 12 has recesses within which the magnet assemblies nest.

As shown in detail in FIG. 3 the preferred embodiment of each magnet assembly 50 and 51 comprises a rectilinear housing 52 of non-magnetic material, such as a temperature resistant plastic. The housing has a circular cross section bore 54 extending between the opposite ends. A cylindrical permanent magnet 56, preferably of neodymium iron-boron, is loosely received in the bore 54 and is supported by a pair of circular end caps 55 and 57 of ferrous material, such as steel. The end caps 55 and 57 are coupled to the permanent magnet 56 by the magnetic attraction and support the magnet 56 within the bore 54 so that the magnet is able to rotate therein. The permanent magnet 56 has diametrically opposed north and south magnetic poles extending longitudinally along the bore and designated by the letters N and S. For purposes of this disclosure, the term "magnet" means a member or material which has been magnetized so as to produce a magnetic field.

The open ends of the bore 54 are closed by a pair of brass end plates 58 and 60 attached to the housing 52. The non-magnetic end plates 58 and 60 are identical, with the internal surface 61 being shown in FIG. 4. That internal surface 61 has a circular raised portion 63 with a pointed pin 62 projecting from the center into the bore 54. The end caps 55 and 57 have central recesses 64 in their outer surfaces within which the tip of the pins 62 are received. The pins form an axle on which the cylindrical permanent magnet 56 rotates, as will be described.

When the contactor 10 is closed, the direct electric current flows through stationary contact 17 as indicated by arrow 66 in FIG. 2. This current produces a magnetic field around the stationary contact which is referred to as a self magnetic field of the current and is indicated by flux lines 68. The self magnetic field extends toward the contact pad 32 where the flux lines pass through the magnet assembly 50. That portion 70 of the self magnetic field around the stationary contact 17, which may be very weak (due to a small current) is enhanced by the strong magnetic field from the permanent magnet 56. A portion 71 of the magnetic field produced by the permanent magnet assembly 50 also extends around a section of the stationary contact 17 between the contact pad 32 and the outer stack 38 of splitter plates.

The direction of the self magnetic field 68 is determined by the direction 66 of the direct electrical current flowing through the stationary contact 17. The direction of that electrical current depends on the polarity of the electrical circuit connected to contactor terminals 14 and 16. That current direction may change from time to time in some installations of the contactor 10, as when a motor connected to the contactor is driven by a load and acts as a generator. When the direction of that electrical current changes, the direction of the self magnetic field also changes. The rotational mounting provided by pins 62 allows the permanent magnet 56 to spin within the housing 52 so that the magnetic field from the permanent magnet 56 automatically aligns with the self magnetic field. Thus the strong permanent magnet's field always will be oriented to enhance the self magnetic field.

With reference to FIG. 1, the combination of the potentially weak self magnetic field and the permanent magnet's relatively strong field initiates arc motion towards the arc chamber. When the contactor 10 opens, the movable contact arm 28 moves away from the stationary contacts 15 and 17, causing the contact pads 30 and 32 to separate and move into the position shown. The rotating permanent magnet already has become aligned to reinforce the strongest self-field of a potentially low current 66. As the contact pads 30 and 32 separate, an electrical arc 72 may form there between. The interaction of the arc current with the magnetic fields 68, 70, and 71 around stationary contact 17 (see FIG. 2) produces a Lorentz force which causes the arc 72 to move from contact pad 32 outward along the stationary contact toward the outside stack 38 of splitter plates in arc extinguishing chamber 34 no matter how weak the self-field 68 of the current 66. At the same time, the arc 72 moves off the other contact pad 30 onto the tip of the moveable contact arm 28.

The arc 72 propagates along the stationary contact 17 and onto the top splitter plate 40 in the outer stack 38. The arc then bridges the vertical gaps between adjacent splitter plates 40 in the outer stack 38. Eventually the arc 72 travels down the outer stack 38 to the point where the other end of the arc travels onto the top splitter plate 40*a* in the inner stack 36. When the arc 72 attaches to the top plate 40*a* in the inner stack 36, both arc chambers are electrically in series generating an arc voltage in a bidirectional manner that is twice in magnitude to that generated in a bidirectional permanent magnet arc driven contactor.

The arc 72 continues propagating further downward onto each subsequent splitter plate 40 in stacks 36 and 38 in both arc chambers. This action forms separate sub-arcs in the vertical gaps between adjacent splitter plates 40. Eventually the arc 72 spans a sufficient number of gaps between the splitter plates of both arc chambers, building up significant arc voltage and extinguishing the arcs.

FIG. 5 depicts an alternative magnet assembly 80 which can be used in place of assembly 50 in FIG. 1. The housing 82 is the same as the previously described housing 52. A permanent magnet 86 has a rectilinear shape with poles that extend longitudinally along opposite sides. Magnet keepers 88 and 90 of ferrous material, such as steel, abut those opposite sides of the permanent magnet 86 to achieve better magnetic field 70 and 71 interaction with arc 72.

The combined structure of the permanent magnet 86 and the magnet keepers 88 and 90 has square ends which fit into similarly shaped recesses in a pair of circular end caps 92 and 94. When the assemblage of these components is slid into the bore 84 of the housing 82, the openings of the bore are closed by a pair of end plates 96 and 98. The end plates 96 and 98 have a structure that is identical to that of end plate 58 in FIG. 4 with pins that extend into recesses 95 in the end caps 92 and 94, thereby enabling the permanent magnet 86 and its keepers 88 and 90 to rotate within the bore 84. Such rotation allows the magnetic field from permanent magnet 86 to automatically align with the self magnetic field from current flowing through the adjacent stationary contact 15 or 17. Thus the permanent magnet's strong field will always be oriented to enhance the potentially weak self magnetic field as described with respect to the embodiment in FIG. 1. Therefore the resultant Lorentz force acting on the arc will always be strong enough to drive the arc off the contact pads 30 and 32 and along stationary contact 17 even when the self magnetic field is weak (low current).

The foregoing description was primarily directed to a preferred embodiment of the invention. Although attention was given to some alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

I claim:

1. An electric current switching apparatus comprising:

first and second contacts being movable with respect to each other into an abutting position and an non-abutting position, the first contact having a conductive member through which electric current flows when the first and second contacts are in the abutting position and that electric current produces a self magnetic field extending in a direction around the conductive member; and a magnet movably mounted adjacent to the first contact within the self magnetic field, and producing a magnetic field which extends around the conductive member, wherein the magnet moves so that the magnetic field extends in the same direction as the self magnetic field.

2. The electric current switching apparatus as recited in claim 1 wherein magnet is a permanent magnet.

3. The electric current switching apparatus as recited in claim 1 further comprising a housing of non-magnetic material with an aperture therein and the magnet located in the aperture.

4. The electric current switching apparatus as recited in claim 1 further comprising a mount having a pair of pins between which the magnet is rotationally supported.

5. The electric current switching apparatus as recited in claim 1 further comprising a housing of non-magnetic material with a circular bore there through and the magnet located in the circular bore; and first and second end plates each closing a different end of the bore and rotationally supporting the magnet.

6. The electric current switching apparatus as recited in claim 1 further comprising a housing of non-magnetic material with a circular bore extending between first and second openings, the magnet located in the aperture; first and second circular end caps coupled to opposite sides of the magnet; a first end plate extending across the first opening and having a first pin which engages the first end cap; and a second end plate extending across the second opening and having a second pin which engages the second end cap, wherein the first and second pins form an axle on which the magnet rotates.

7. The electric current switching apparatus as recited in claim 6 wherein the magnet has a cylindrical shape.

8. The electric current switching apparatus as recited in claim 6 wherein the magnet has a rectilinear shape.

9. The electric current switching apparatus as recited in claim 8 further comprising a pair of keepers of a ferrous material abutting opposite sides of the magnet between the first and second end caps.

10. The electric current switching apparatus as recited in claim 1 further comprising an arc extinguishing chamber adjacent to the first and second contacts, wherein interaction of the self magnetic field and the magnetic field with an arc, that forms between the first and second contacts, drives the arc toward the arc extinguishing chamber.

11. An electric current switching apparatus comprising:

a stationary contact having a conductive member through which electric current flows, wherein that electric current produces a self magnetic field extending in a direction around the conductive member;

a movable contact which in a closed state of the apparatus abuts the first contact and in an open state of the apparatus is remote from the first contact;

a magnet rotatably mounted adjacent to the stationary contact within the self magnetic field, and producing a magnetic field which extends around the conductive member, wherein the magnet rotates so that the magnetic field extends in the same direction as the self magnetic field; and an arc extinguishing chamber adjacent the stationary contact and the movable contact, wherein interaction of the self magnetic field and the magnetic field with an arc formed between the stationary contact and the movable contact drives the arc toward the arc extinguishing chamber.

12. The electric current switching apparatus as recited in claim 11 further comprising a housing of non-magnetic material with a circular bore extending between first and second openings, the magnet located in the circular bore; first and second circular end caps coupled to opposite ends of the magnet; a first end plate extending across the first opening and having a first pin which engages the first end cap; and a second end plate extending across the second opening and having a second pin which engages the second end cap, wherein the first and second pins form an axle on which the magnet rotates.

13. The electric current switching apparatus as recited in claim 12 wherein the magnet has a cylindrical shape.

14. The electric current switching apparatus as recited in claim 12 wherein the magnet has a rectilinear shape.

15. The electric current switching apparatus as recited in claim 14 further comprising a pair of keepers of ferrous material abutting opposite sides of the magnet between the first and second end caps.

* * * * *